US008371903B2

(12) United States Patent
Goetsch et al.

(10) Patent No.: US 8,371,903 B2
(45) Date of Patent: Feb. 12, 2013

(54) PORTABLE DEMILITARIZATION APPARATUS FOR SEGMENTING ORDNANCE

(75) Inventors: Duane A. Goetsch, Andover, MN (US); Josh E. Eigh, Bloomington, IN (US); Nathan R. Perklna, St. Paul, MN (US); Steven J. Schmit, Elk River, MN (US); Ryan M. Smith, Minnetonka, MN (US); George J. Young, Zimmerman, MN (US)

(73) Assignee: G.D.O. Inc., Elk River, MN (US)

( * ) Notice: Subject to any disclaimer, the term of this patent is extended or adjusted under 35 U.S.C. 154(b) by 648 days.

(21) Appl. No.: 12/629,488

(22) Filed: Dec. 2, 2009

(65) Prior Publication Data

US 2012/0227558 A1 Sep. 13, 2012

Related U.S. Application Data

(60) Provisional application No. 61/200,614, filed on Dec. 2, 2008.

(51) Int. Cl.
*B24B 1/00* (2006.01)

(52) U.S. Cl. ..... 451/39; 451/36; 451/38; 269/61; 269/105; 269/106

(58) Field of Classification Search ..... 451/36, 451/38, 39; 269/61, 105, 106
See application file for complete search history.

(56) References Cited

U.S. PATENT DOCUMENTS 3,771,393 A * 11/1973 Gatto et al. ..... 82/53.1
5,540,526 A * 7/1996 Hyatt et al. ..... 408/1 R
7,040,629 B2 * 5/2006 Horisberger ..... 279/4.12

* cited by examiner

*Primary Examiner* — Lee D Wilson
*Assistant Examiner* — Shantese McDonald
(74) *Attorney, Agent, or Firm* — Henry E. Naylor

(57) ABSTRACT

Disclosed is a portable demilitarization apparatus and system for segmenting an ordnance and is comprised of a fixed housing having a gantry/robotic positioning system, a high pressure water jet cutting head, and a rotational drive subassembly and a slideable main assembly comprised of a cradle subassembly, a centering ring subassembly, a collection subassembly and a rotational drive mechanism.

26 Claims, 16 Drawing Sheets

PORTABLE DEMILITARIZATION APPARATUS FOR SEGMENTING ORDNANCE

CROSS-REFERENCE TO RELATED APPLICATIONS

The application claims priority from Provision Application 61/200,614 filed Dec. 2, 2008, the disclosure of which is hereby incorporated by reference in its entirety.

FIELD OF THE INVENTION

The present invention relates to a portable demilitarization apparatus and system for segmenting an ordnance and is comprised of a fixed housing having a gantry/robotic positioning system, a high pressure water jet cutting head, and a rotational drive subassembly and a slideable main assembly comprised of a cradle subassembly, a centering ring subassembly, a collection subassembly and a rotational drive mechanism.

BACKGROUND OF THE INVENTION

In many instances, items potentially presenting an explosive hazard (MPPEH), such as an ordnance, are located in remote areas or in areas that make it unfeasible to move the ordnance, or other items, from a safety and/or economic standpoint. As a result, it is often necessary to bring equipment to the location of the item to determine if it is inert or to render it safe. Waterjet cutting equipment is a preferred type of equipment used to investigate such items. Waterjet technology is useful for the cutting of items, such as military shells, into small pieces that can then be inspected to determine the energetic/hazardous material content if unknown. Aside from determining the internal contents of items, waterjet technology is useful for cutting live ordnance into smaller pieces so that these pieces can be further processed.

Previous systems utilized to access and segment ordnance and MPPEH items in remote areas have not been outfitted with state of the art technology to accomplish the work. They have typically utilized very basic high pressure waterjet technology, or a lesser technology, that is inherently unsafe, in order to field a system. Such systems are typically operated at relatively low rates and are generally inefficient in the field, thus adding significantly to the costs of the operation. Upgrades to such technology, with state of the art components, to create a new processing scheme is necessary to place a system on the market that is efficient, safe, and environmentally compliant enough to alleviate shortcomings of the prior art.

Two high pressure waterjet system technologies have been utilized to process MPPEH items in a remote, field, or unimproved area. The first of these is a so-called first generation system developed by Gradient Technology of Elk River, Minn. that affixed a high pressure waterjet head to a ring, which is used to cut around the circumference of the item to be accessed. That system is inefficient because of the requirement of manual positioning of the high pressure waterjet head by operators prior to every operational step. Additionally, this system was not environmentally friendly because of the difficulty of capturing the high pressure waterjet stream as it rotated about the item.

The other system was simple high pressure waterjet head used by PIKA International for MPPEH clean-up work in Puerto Rico. That system was used to access small items with a fixed high pressure waterjet head to investigate the internals of the items. It was not built to process large MPPEH items that pose greater problems during demilitarization.

While some systems exist for demilitarizing large pieces of ordnance in the field, there still exists a need in the art for improved systems that are more cost effective, safer and/or environmentally compliant.

SUMMARY OF THE INVENTION

An assembly for segmenting a potentially explosive cylindrical item comprising:

a) a fixed housing having:
   i) four enclosing sides and one enclosed end;
   ii) a waterjet cutting head having two or more degrees of movement;
   iii) a rotational drive subassembly capable of securing one end of said cylindrical item and centering and rotating it;

b) a centering ring subassembly having a plurality of jaws that are radially adjustable for securing said cylindrical item and which is capable of rotating with said cylindrical item;

c) a slideable main assembly comprised of:
   i) a cradle for supporting said cylindrical item, which cradle has a bar supporting member and a slideable air member and is capable of moving up and down;
   ii) a collection subassembly for collecting cut sections of said cylindrical item and for collecting waste water from said waterjet cutting head.

In a preferred embodiment, there is provided a robotic positioning system connected to the waterjet cutting head.

In another preferred embodiment the centering ring subassembly is positioned outside of the fixed housing during loading of the cylindrical item to be segmented.

In another preferred embodiment the fixed housing contains a rail system extending from inside of the housing to outside of the housing.

In another preferred embodiment each of the cradle, and collection subassemblies are moveable in an up and down direction by use of one or more hydraulic cylinders that are remotely controlled.

DETAILED DESCRIPTION OF THE INVENTION

The present invention relates to the use of a portable waterjet system comprised of a variety of components that can collectively be transported to and located at any site where demilitarization work is to be performed. The present system is comprised of a fixed housing assembly and a slideable main assembly. All equipment inside the enclosure during operation will preferably comply with military safety standards. Hydraulic or pneumatic operation of equipment is preferred. Electrical equipment classified for the intended operation is also preferred. Peripheral equipment that supports the equipment inside the enclosure is located outside of the enclosure. Non-limiting examples of such peripheral equipment include such things as a high pressure waterjet pump, abrasive feeding equipment, hydraulic power unit(s), air compressor(s), and electrical supply cabinets. Collectively, this equipment can be placed at a remote location in close proximity to items and can be used to render useless and safe the item to be segmented.

Prior commercial systems that were utilized the use of high pressure waterjet technology for accessing MPPEH items did so by utilizing a fixed high pressure waterjet cutting head, or a high pressure waterjet cutting head that was rotated around the MPPEH item to produce circumferential cuts around the body of the MPPEH item in order to cut it into segments. The system of the present invention eliminates many of the short comings of prior systems and improves waterjet technology to a broader spectrum of items.

The term "ordnance" is often used herein to describe the cutting operation. It will be understood that most MPPEH items that will be segmented in accordance with the present invention will be either munitions (ordnance) or rocket motors both of with will have an outer metal casing that have contained therein an energetic material, such as an explosive or propellant inside. Therefore, the terms "ordnance", "munition", rocket motor, "MPPEH item" and "item" are sometimes used interchangeably herein.

Figure 1:
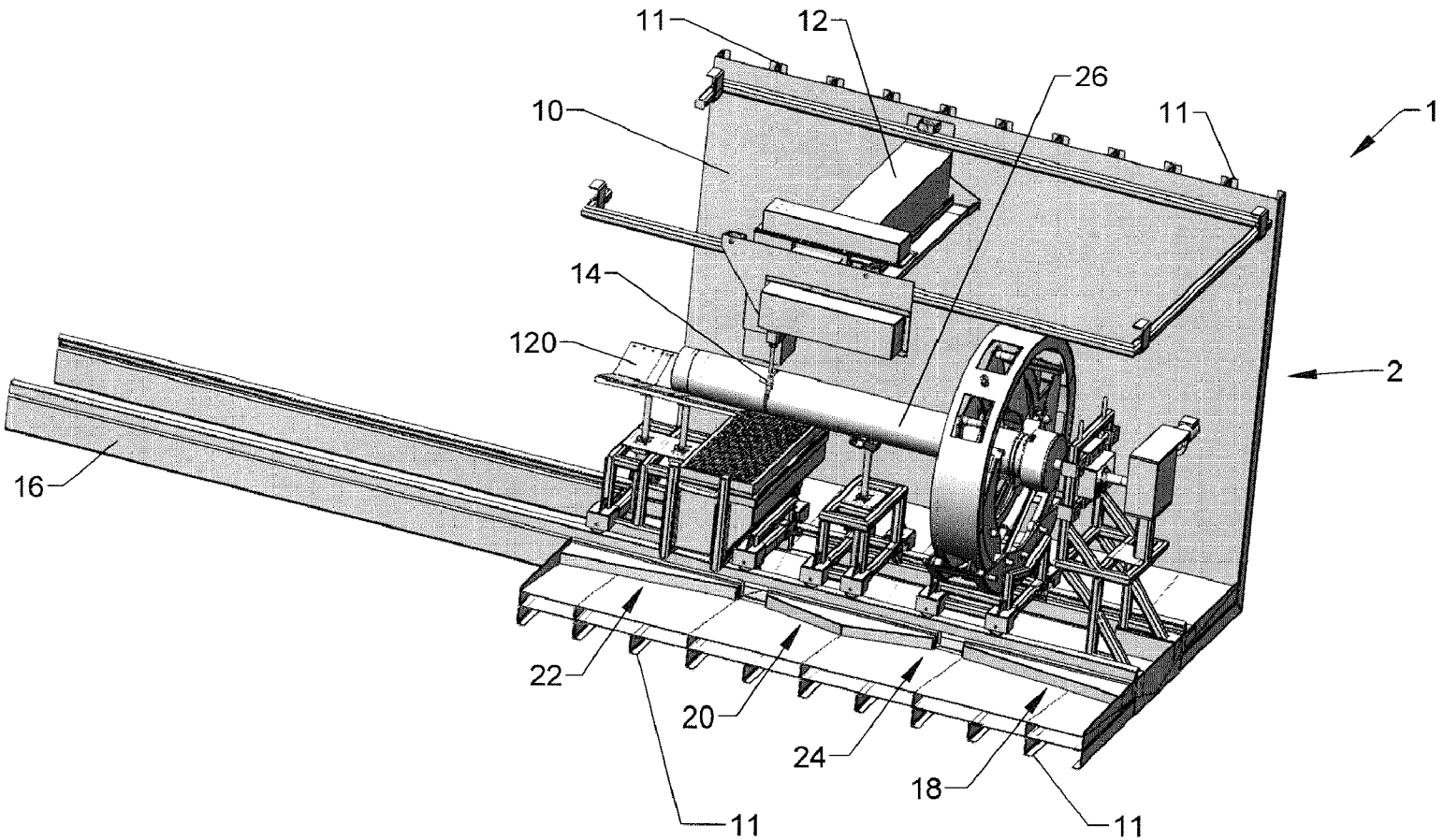
FIG. 1 hereof is a perspective view of the portable demilitarization apparatus of the present invention.

This invention can be better understood with reference to the Figures hereof. All components that are similar in each Figure will have the same number in every Figure hereof, but every Figure will not have every component numbered. Further, lines with arrow head in the Figures hereof indicate a subassembly comprised of more than one individual part, even the jaws 70 of centering ring subassembly 24 which contain a plurality of parts. FIG. 1 hereof shows a preferred embodiment of the present invention comprised of a fixed housing assembly 1 and a slideable main assembly 2 that can be slid, preferably on rails, in and out of fixed housing assembly 1. It will be understood that the terms "slid" and "slideable" will mean any means for transporting the slideable main assembly 2 into housing assembly 1. This includes wheels, or rollers, on tracks; slides; as well as polished or other slippery surfaces. Preferred are rollers and more preferred are inverted V-wheels to match a V-shaped track system 16. Fixed housing assembly 1 and slideable main assembly 2 are more clearly identified as assembly units in FIG. 3 hereof which will be discussed below. Housing, or enclosure component 10 of fixed housing assembly 1 is preferably a rectangular enclosure having four enclosing sides and one enclosed end. The four enclosing sides can be thought of as a top side, a bottom side with two opposing sides, each side being secured, preferably by welds, to the next nearest side at right angles. It is understood that these four sides can be further strengthened by a metal cross member beams 11 on their outer surface. It is preferred that the enclosed end be removeable, preferably by bolting it to the ends of the four sides of the housing. The other end of the enclosure is open to allow slideable main assembly 2 to be moved in and out of the housing assembly 1 and to allow for removal of cut segments of a MPPEH item. The components (sides and end) of housing enclosure 10 are constructed of a material, such as sheet steel or other blast resistant material, that can be placed at the work site and have dirt or other materials placed around it to provide blast protection in the event of an incident. The two opposing sides, as well as the top, of the housing structure must be able to withstand the weight of the dirt or other material placed around it. Consequently, it is preferred that cross member beams 11 be used, which cross member beams will preferably be constructed of steel.

The inner surface of the top side of housing enclosure 10 has secured thereto a gantry system 12 supporting a waterjet cutting head 14. The gantry system will have at least two degrees of movement, such as up/down and side-to-side. It is preferred that the gantry have at least one additional degree of movement, preferably back-and-forth along the length of the housing enclosure. It is within the scope of this invention that the gantry system have greater than 3 degrees of movement, preferably at least 4 degrees of movement, more preferably at least 5 degrees of movement. It is also preferred that the gantry be a robotic gantry. That is, a gantry whose degrees of movement are controlled by robotic technology that is controlled by an operator at a safe location from the demilitarization apparatus of the present invention. The additional degrees of movement can be accomplished by having waterjet cutting head on a ball/joint mechanism (not shown). Waterjet cutting head 14 can be any conventional waterjet cutting head capable of producing waterjet pressures from about 10,000 to about 150,000 psig, preferably from about 30,000 to about 150,000 psig. It is preferred that waterjet cutting head 14 also be one that is capable of producing a jet of water of appropriate pressures containing an abrasive material, such as a garnet of suitable particle size. It will be understood that waterjet cutting head 14 will be part of a waterjet system comprised of a suitable pump and hoses (not shown). Housing assembly 1 will also contain a rail system 16 on which the slideable main assembly can be moved into and out of housing assembly 1. Rotational drive subassembly 18 is preferably fixed at the end of rail system 18 for centering and rotating the item to be segmented. A more detailed view of rotational drive subassembly can be found in FIG. 14 and will be discussed in more detail below.

Components of slideable main assembly 2 include cradle subassembly 20 and collection subassembly 22. Centering ring subassembly 24 can be a component of fixed housing assembly 1 or it can be a component of slideable main assembly 2. That is, centering ring subassembly 24 can be positioned outside housing assembly 1 while placing ordnance 26 into position. Alternatively, centering ring subassembly can be positioned inside of fixed housing assembly 1 to receive the ordnance after it has been placed on the V-shaped bar of cradle subassembly 20 and platform 120 of collection subassembly 22 then moved into housing assembly 1 where it is centered through centering ring 24 and its base positioned into securing member 140 of rotational drive subassembly 18. After the ordnance is positioned through centering ring 24 its jaws 70 are activated by hydraulic cylinder 88 which closes them radially until positioning pads 72 make contact with surface of ordnance 26. The function and operation of centering ring subassembly 24 will be discussed in greater detail below when discussing FIGS. 7, 8, and 9. It is preferred that centering ring subassembly 24 be positioned outside of fixed housing assembly 1 when loading the ordnance onto slideable main assembly 2.

Figure 2:
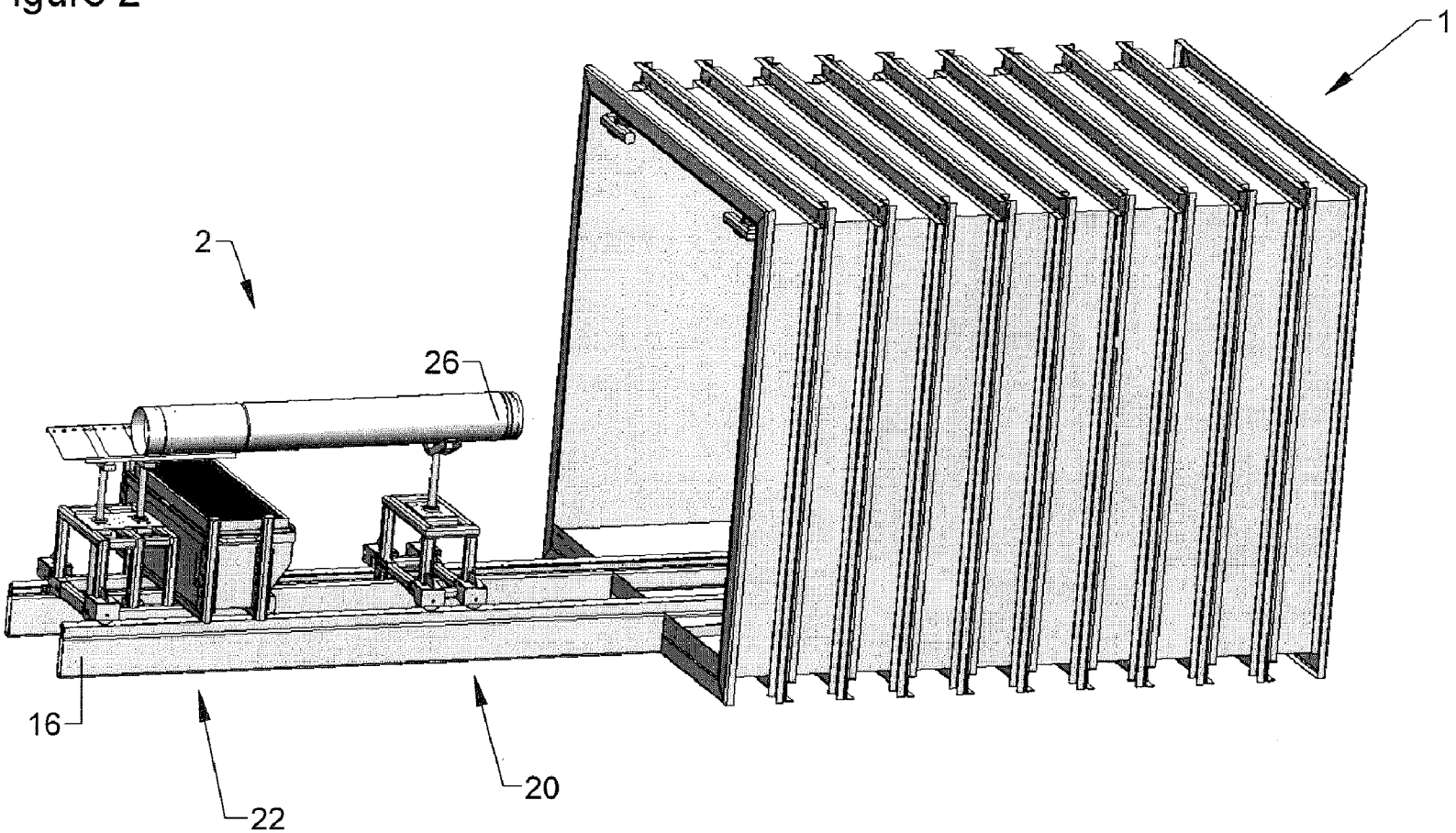
FIG. 2 hereof is an elevated frontal view of a munition positioned on a moveable subassembly of the present invention outside of the housing enclosure.
Figure 3:
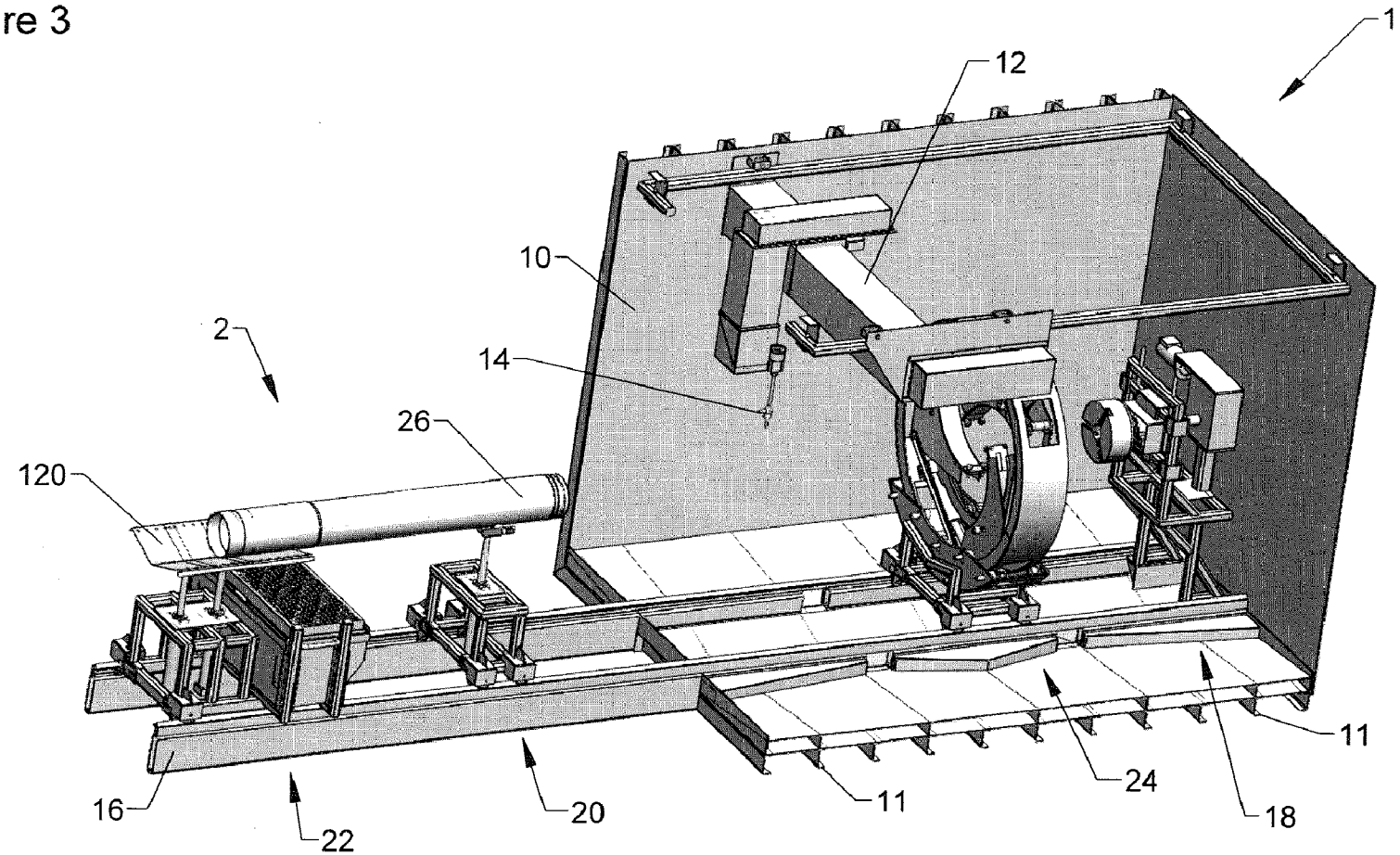
FIG. 3 is the same elevated frontal view as shown in FIG. 2 hereof except part of the enclosure is cut away to show the remaining components of the system of the present invention.
Figure 4:
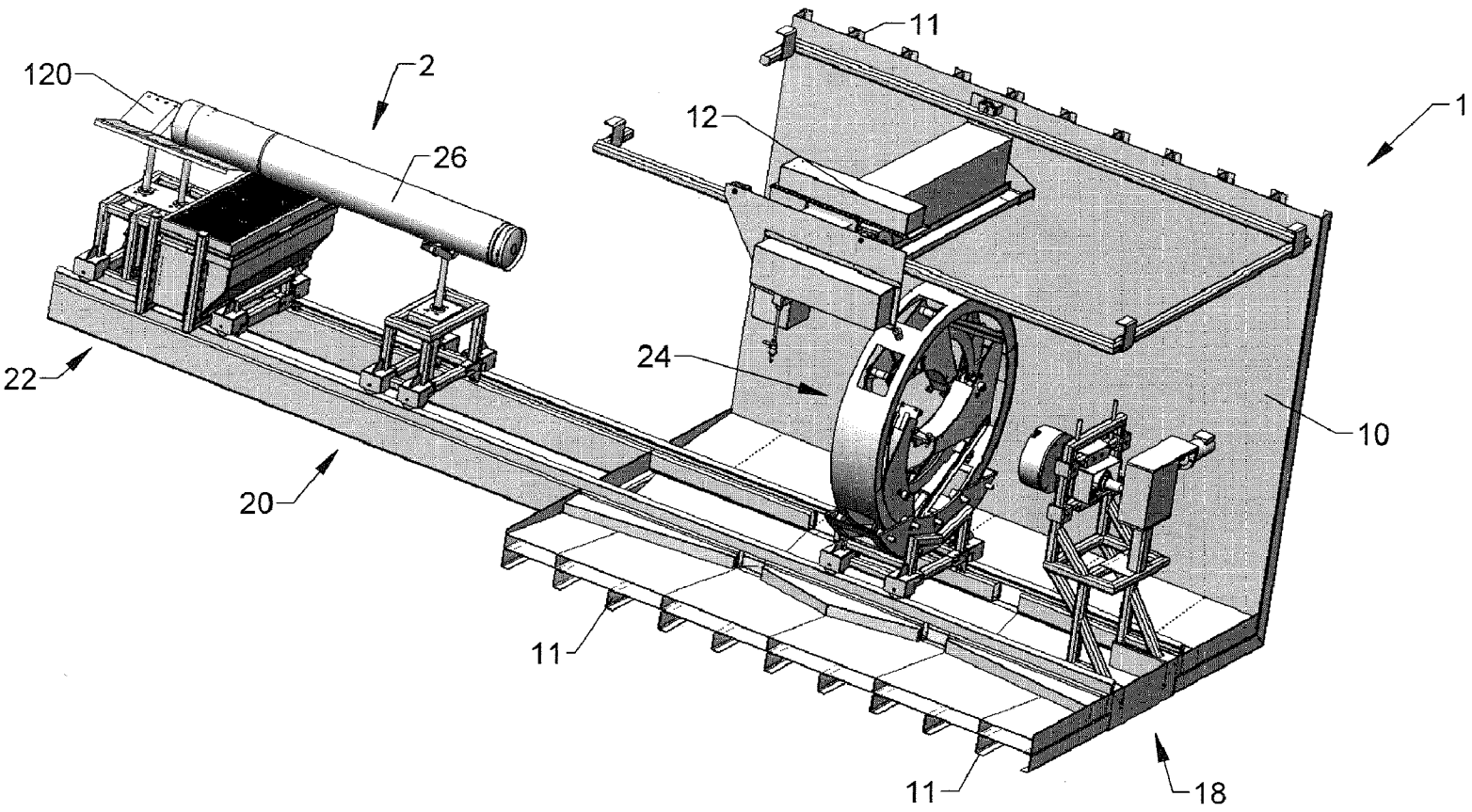
FIG. 4 hereof is a perspective view from the rear of the apparatus of the present invention showing the relationship of the various components.
Figure 5:
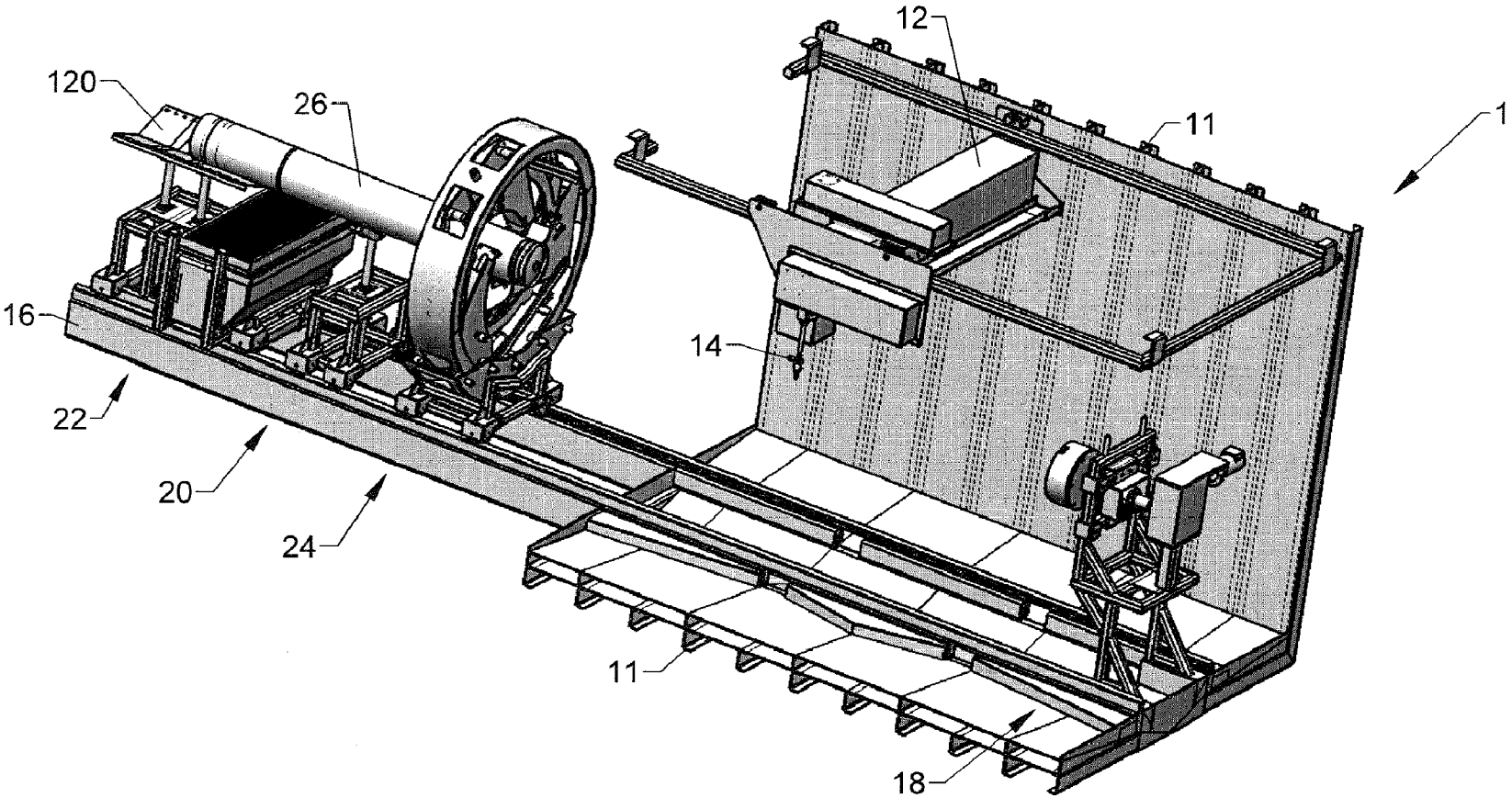
FIG. 5 hereof is a rear perspective view, similar to that of FIG. 4 hereof except the centering ring component is shown as an element of the moveable subassembly that is moved into the housing enclosure after the munition is positioned in place.

FIG. 2 hereof shows slideable main assembly 2 positioned outside of housing assembly 1 and loaded with a cylindrical ordnance 26 to be segmented. This version of slideable main assembly 2 does not include centering ring subassembly 24 as a component. FIGS. 3 and 4 hereof show different elevated perspective views of the apparatus of FIG. 2, but with the interior of housing assembly 1 exposed to show the gantry 12, waterjet cutting head 14, centering ring subassembly 24, and rotational drive subassembly 18. FIG. 5 shows an embodiment wherein centering ring subassembly 24 is a component of slideable main assembly 2 and is positioned outside of fixed housing assembly 1. When in this position, the MPPEH item, in this case a munition, is placed onto the platform 120 of collection subassembly 22, cradle 110 of cradle subassembly 20 and positioned through the center of centering ring subassembly 24 after which jaws 70 are closed so positioning pads 72 hold the munition firmly in place and in substantial longitudinal alignment. The entire slideable main assembly 2, with the munition held radially straight along its longitudinal axis, is moved into the housing enclosure and positioned so that the base of the munition is held and centered in place by securing device (shown in more detail in FIG. 14 hereof) of rotational drive subassembly 18, as shown in FIG. 1 hereof.

Figure 6:
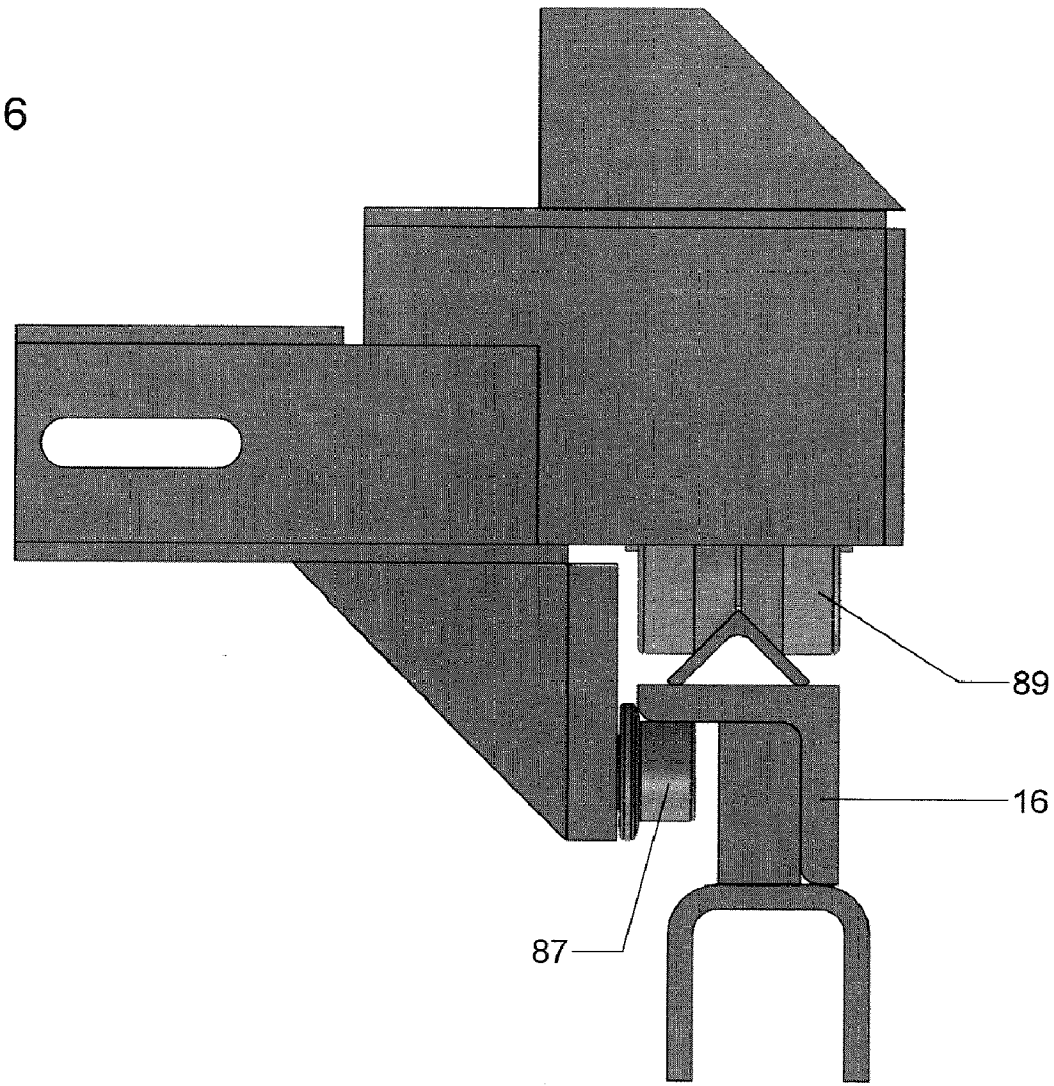
FIG. 6 is detailed view of the wheel/track relationship for all slideable subassemblies.

FIG. 6 hereof is a cross sectional view of the wheel/track system of the present invention. The wheels 89 are inverted V-shaped to complement the preferred inverted V-shape of the track system 16. Flange 87 is provided to hold all slideable subassemblies 20, 22, and 24 on the track system. All such slideable subassemblies will have one or more pairs of wheels. It is to be understood that while the inverted V-shape is preferred any other suitable geometry for a matching wheel or roller/track system can be used in the practice of the present invention.

Figure 7:
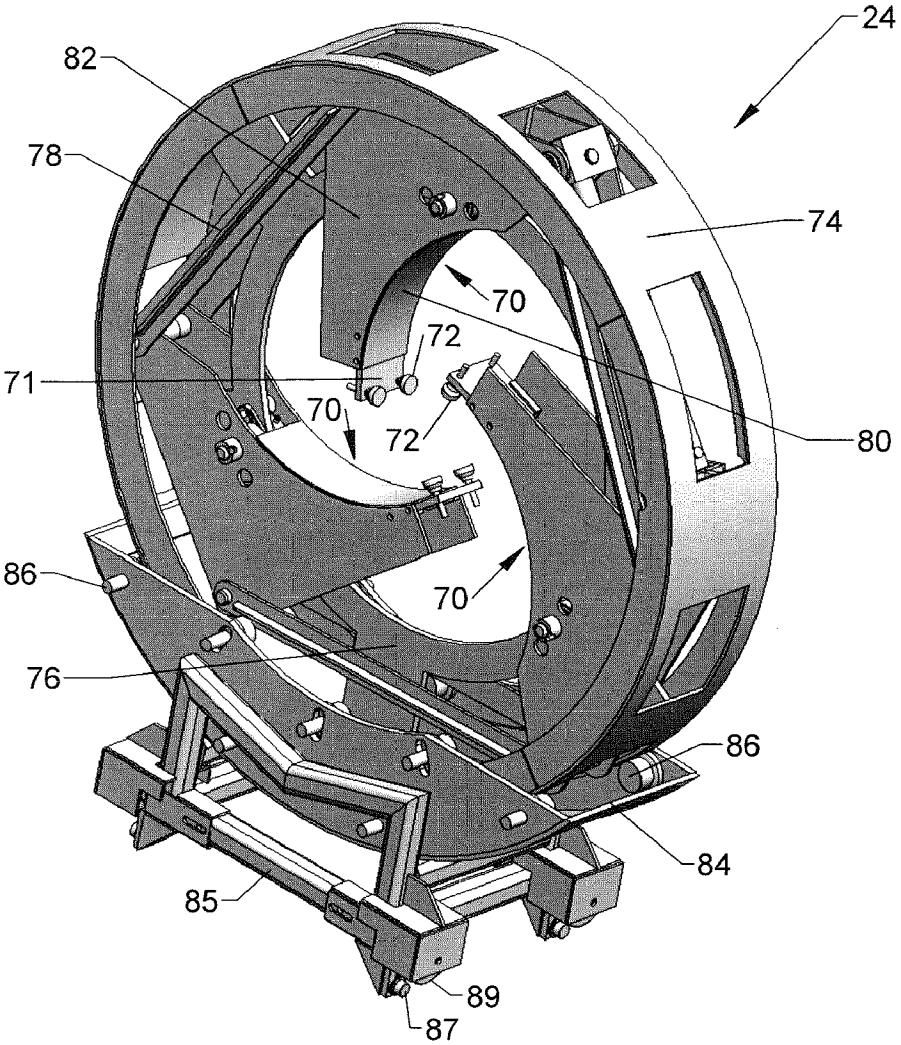
FIG. 7 hereof is a perspective view of the centering ring assembly for helping to keep the munition aligned along its longitudinal axis during fluid jet cutting.
Figure 8:
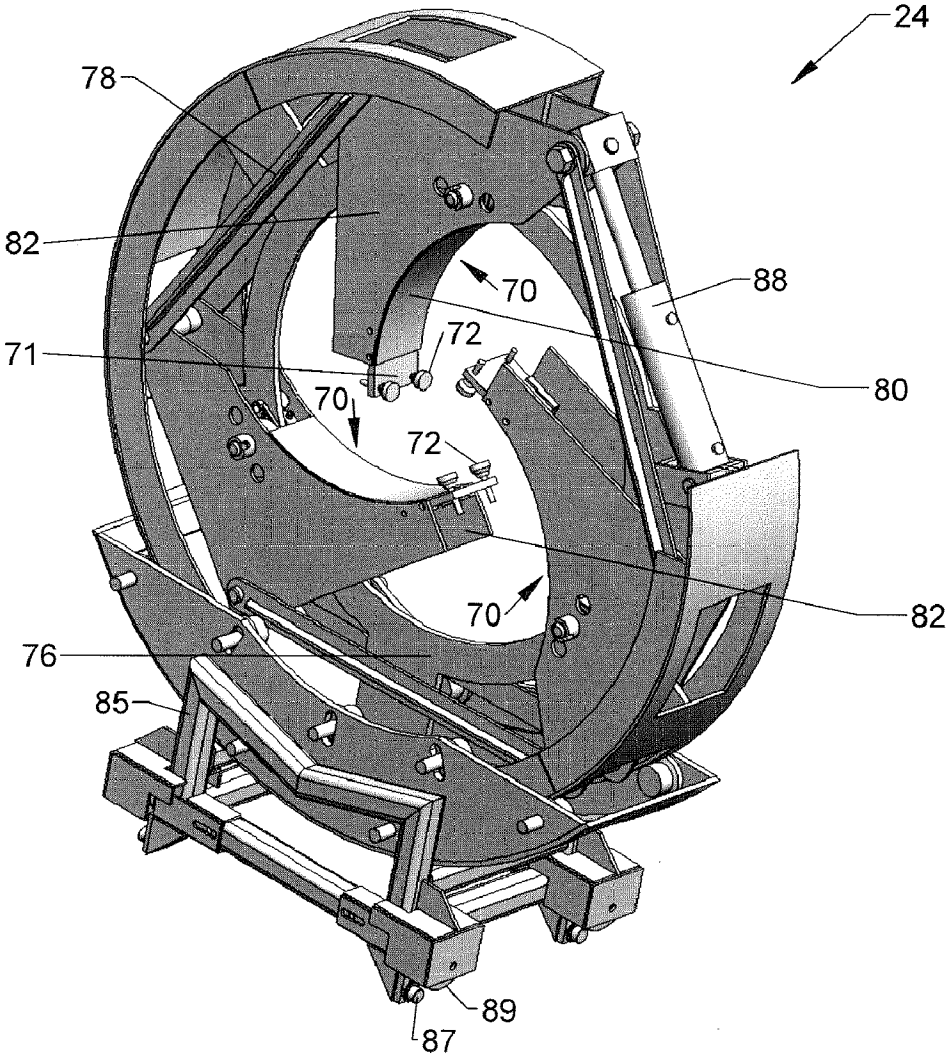
FIG. 8 hereof is the same perspective view of the centering ring assembly but with a section of its exterior band cut-away to show the hydraulic cylinder used to operate the jaws of the centering ring assembly.
Figure 9:
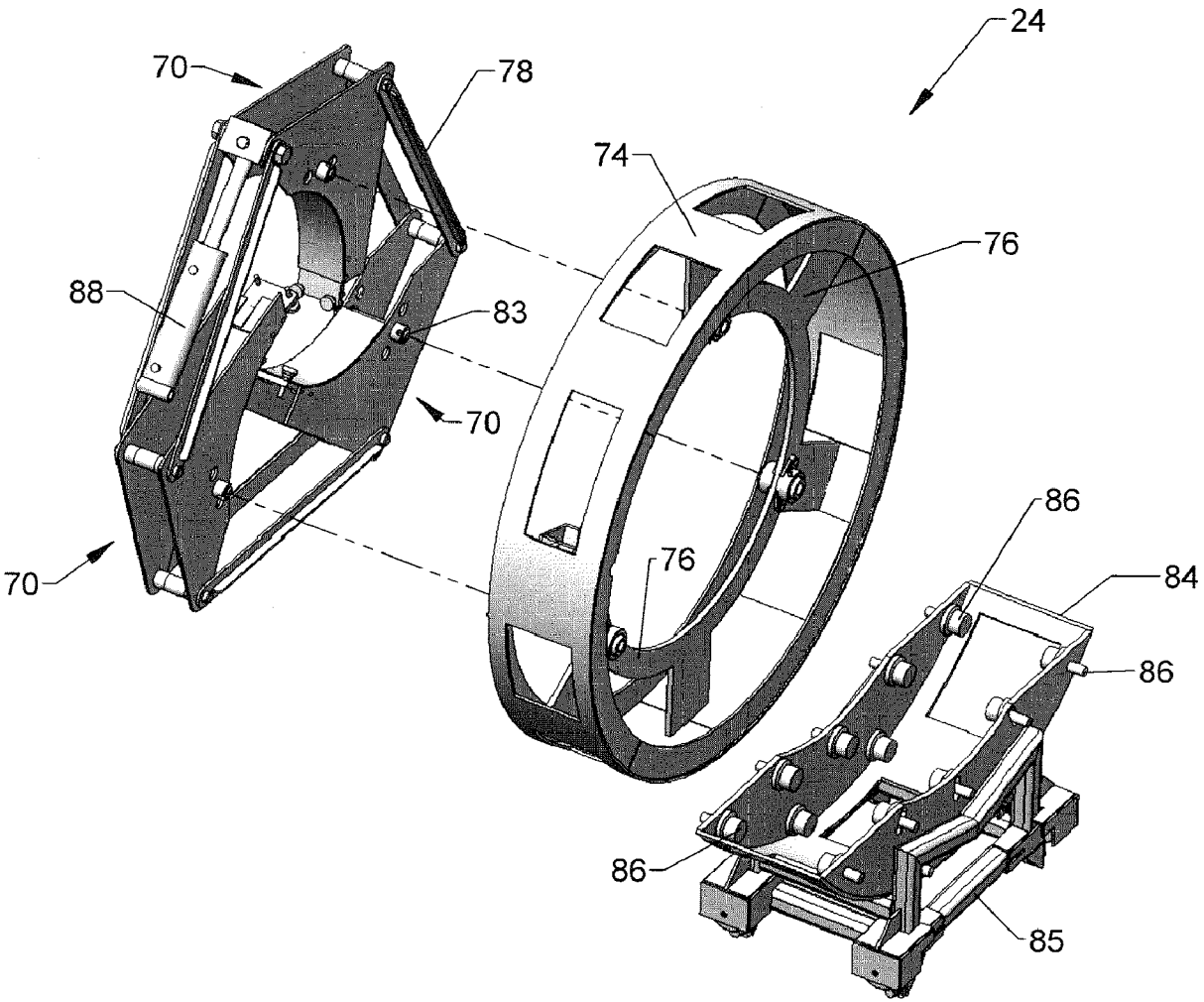
FIG. 9 hereof is an exploded view of the centering ring subassembly of the present invention showing the relationship and positioning of its parts.

FIGS. 7, 8, and 9 are representations of a preferred centering ring subassembly 24 of the present invention. The centering ring subassembly 24 is comprised of an outer band 74, a stabilizing circular inner ring 76 secured along the center of the inner surface of outer band 74, a plurality of jaws 70, positioning pads 72, and links 78 pivotally connecting each jaw to a neighboring jaw. Each jaw 70 is comprised of a pair of opposing sides, or wall plates, 82 separated by a separator member 80 to securely maintain sides 82 at a predetermined distance apart, thus defining the width of each jaw. At the end of each jaw is a lip 71 containing positioning pads 71, preferably a pair of positioning pads secured to each lip 71. It is preferred that positioning pads 72 to inserted through lips 71 by a screw which is an integral part of positioning pads 72. Each jaw is held in position by use of a pin, or screw 83 that passes through one side of a jaw, then through a hole in stabilizing inner ring 76, then through the opposing side plate 82 of the jaw. Any suitable pinning or securing device can be used for the pin, such as a cotter pin or screw and bolt system. It is preferred that there be 3 jaws and that they be positioned and shaped so that when they are fully opened the opening is circular in shape. It is also preferred that the lips 71 and positioning pads 72 contact the surface of the item to be segmented substantially equidistant apart and that substantially the same pressure be applied by each jaw 70. Jaws 70 are opened and closed by use of a hydraulic cylinder 88 that is preferably remotely controlled. For example, as cylinder 88 expands or contracts jaws 70 move radially inwardly and outwardly respectively to accommodate different sized items to be segmented. Also part of the centering ring subassembly 24 is shell 84 which is wider than ring 74 and which has substantially the same curvature as band 74. Shell 84 has secured to each of its inner surfaces rollers 86 positioned to also match the curvature of band 74 to allow the ring to freely rotate. The entire centering ring subassembly 24 will have a supporting structure 85 which contains wheels 89 and flange 87 to help secure centering ring subassembly 24 to tracks 16.

Figure 10:
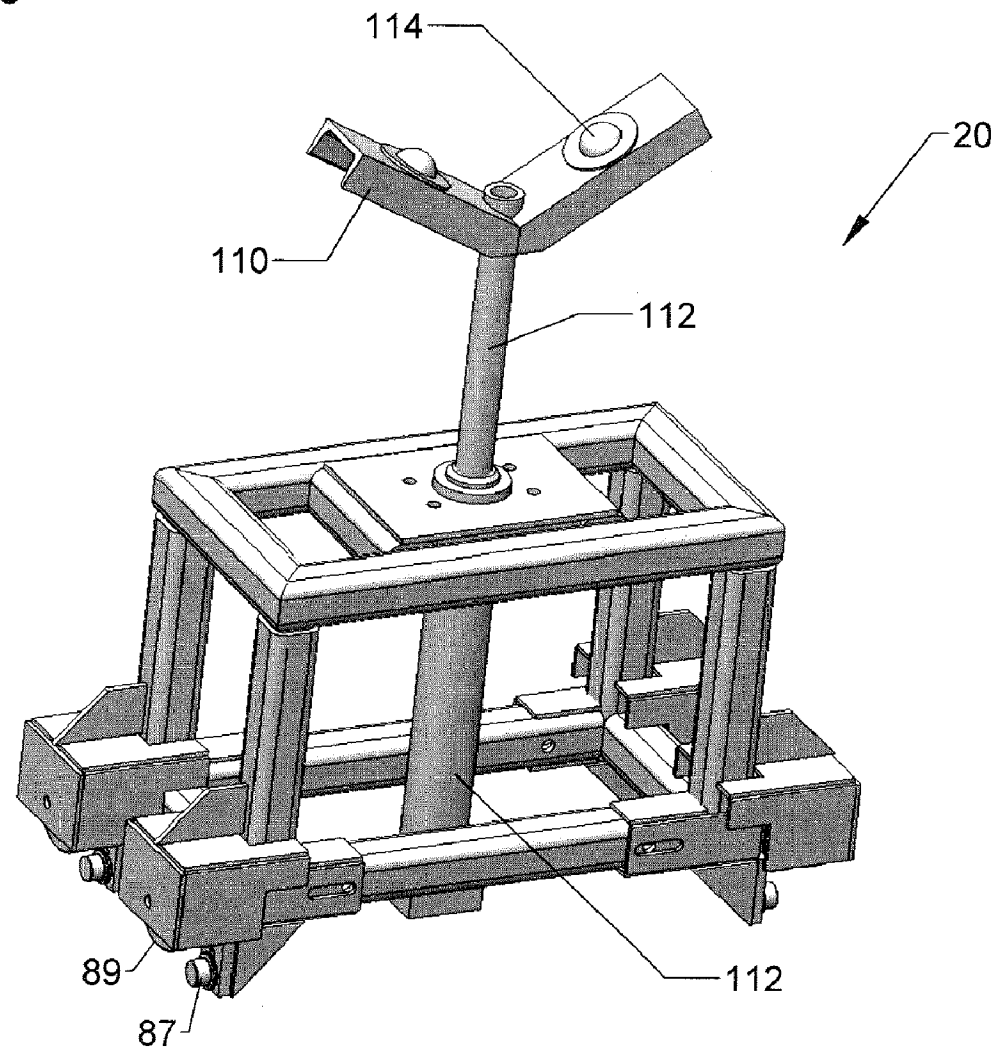
FIG. 10 hereof is a perspective view of the cradle subassembly of the present invention.
Figure 11:
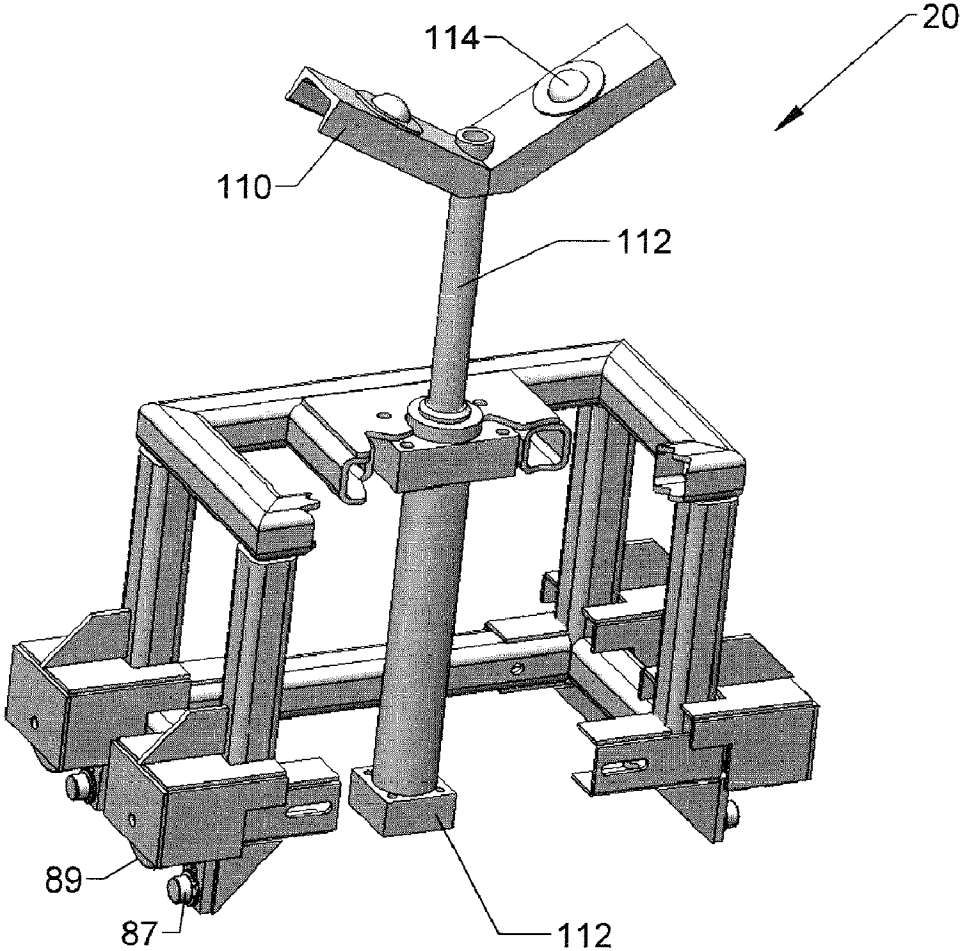
FIG. 11 hereof the same perspective view of the cradle subassembly of the present invention but with a portion of its supporting structure cut-away showing the hydraulic cylinder used to move the cradle up and down.

FIGS. 10 and 11 show a preferred cradle subassembly 20 of the present invention for supporting the MPPEH item when being positioned prior to or concurrent with position it into centering ring subassembly 24. Cradle subassembly 20 is comprised of a V-shaped bar support member 110 which is secured to hydraulic piston 112, which is also preferably remotely controlled. It is preferred that bar support member 110 be constructed to aid in the movement of the item to be segmented along its surface. Non-limiting examples of suitable construction include ball bearing embedded into the top surface of support member 110 or that it simple be constructed of a material with low friction coefficient, such as Teflon or polished stainless steel. It is preferred that ball bearings 114 be used to help move the item longitudinally in place.

Figure 12:
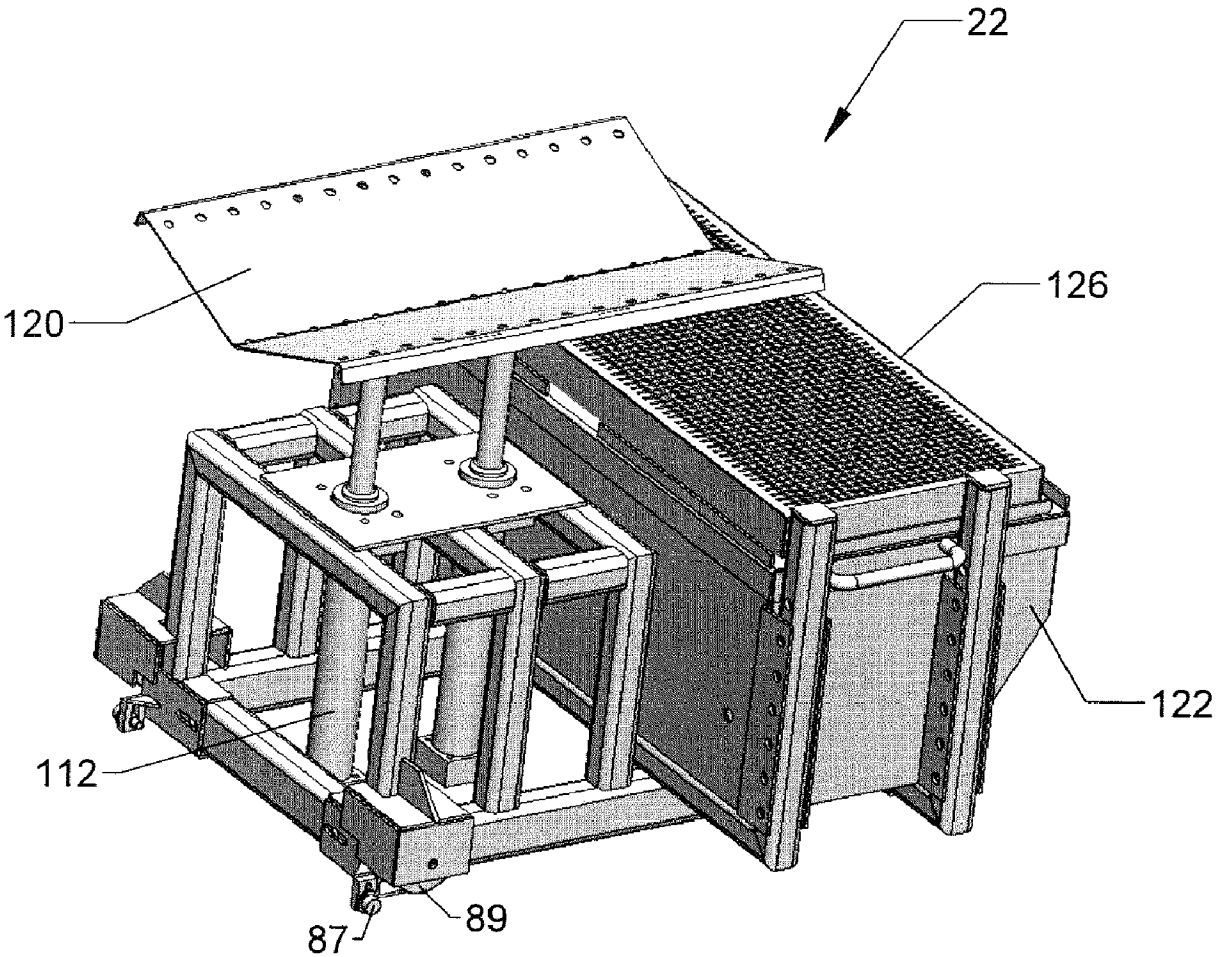
FIG. 12 hereof is a perspective view of the collection subassembly of the present invention showing a preferred platform assembly for supporting a front segment cut from an ordnance. Also shown in this Figure is a collecting tank for holding the swarf resulting from the cutting operation.
Figure 13:
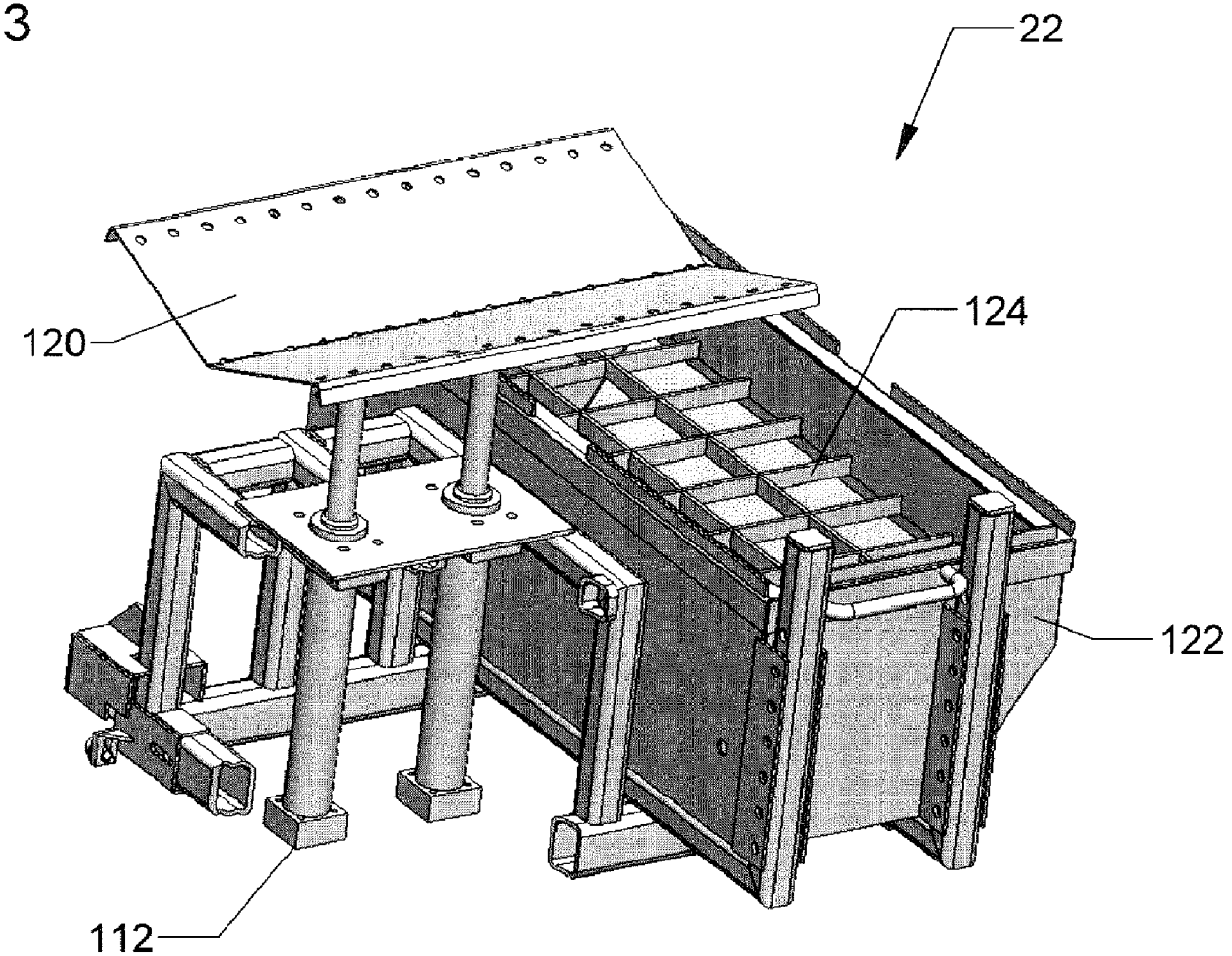
FIG. 13 hereof is the same perspective view of the collection subassembly as FIG. 12 hereof except a portion of the supporting structure for the platform is cut-away to show the hydraulic cylinder system for adjusting the height of the platform.

FIGS. 12 and 13 show a preferred collection subassembly 22 of the present invention. Collection subassembly 22 is comprised holding tank 122 of suitable size for the volume of water used during the cutting operation. Holding tank 122 is positioned under the section of the item being cut and collects the waste water/abrasive and any swarf. Holding tank 122 can be manually adjusted up and down depending on the diameter of the item being segmented. It is within the scope of this invention that holding tank 122 be continuously or periodically emptied during the cutting operation by use of any suitable device, such as a pump or an educator. Also part of collection subassembly 22 is platform 120 positioned just under the segment of the item being cut from the item collects, or holds the separated segment in place for disposal. Platform 120 is secured to one or more hydraulic cylinders 124 that are preferably remotely controlled to adjust the height of platform 120 depending on the size of the item being segmented. FIG. 12 shows one preferred embodiment of the present invention wherein a porous sheet of suitable material 126 sits at the surface of the tank to help dissipate the energy of the waterjet striking it from about. FIG. 13 shows tank 122 with the surface layer of dissipating material removed and showing the underlying support structure 124 which is preferably comprised of metal, preferably stainless steel, in a grid patter to allow liquid to freely flow into tank 122.

Figure 14:
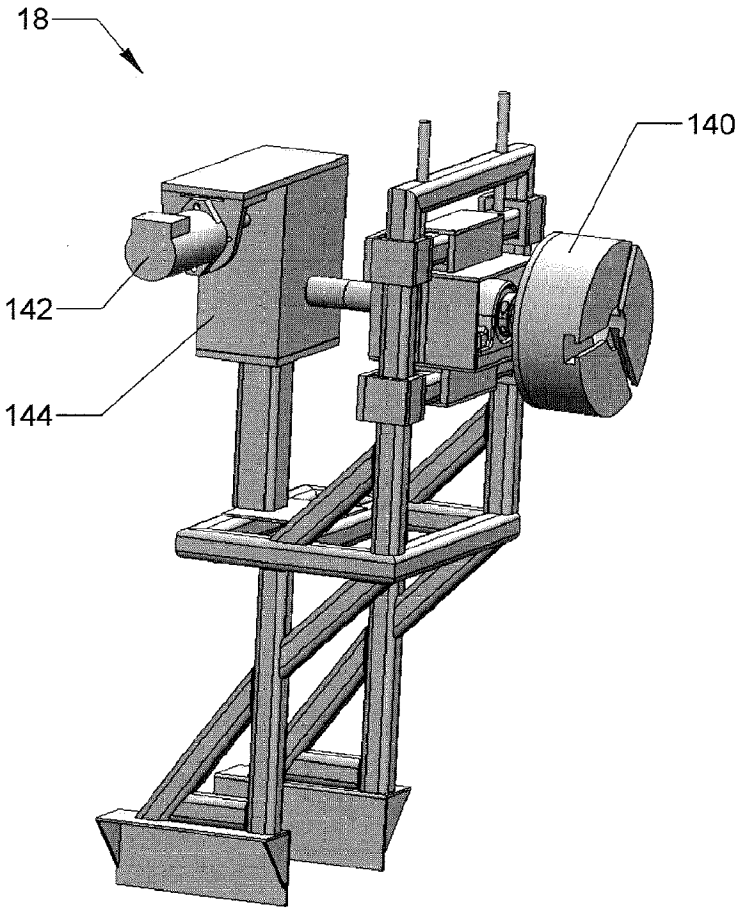
FIG. 14 hereof is an isolated view of a preferred rotational drive subassembly of the present invention.
Figure 15:
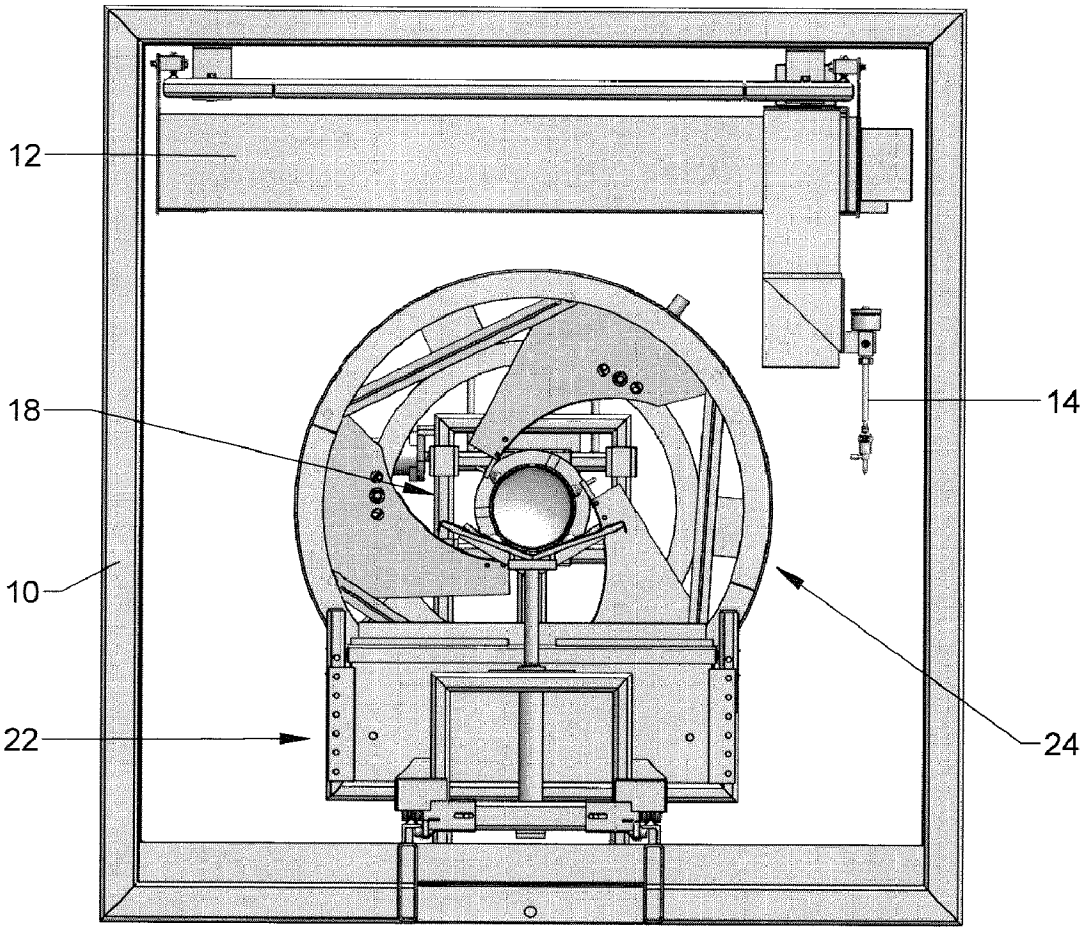
FIG. 15 hereof is a front view of the portable demilitarization apparatus of the present invention.
Figure 16:
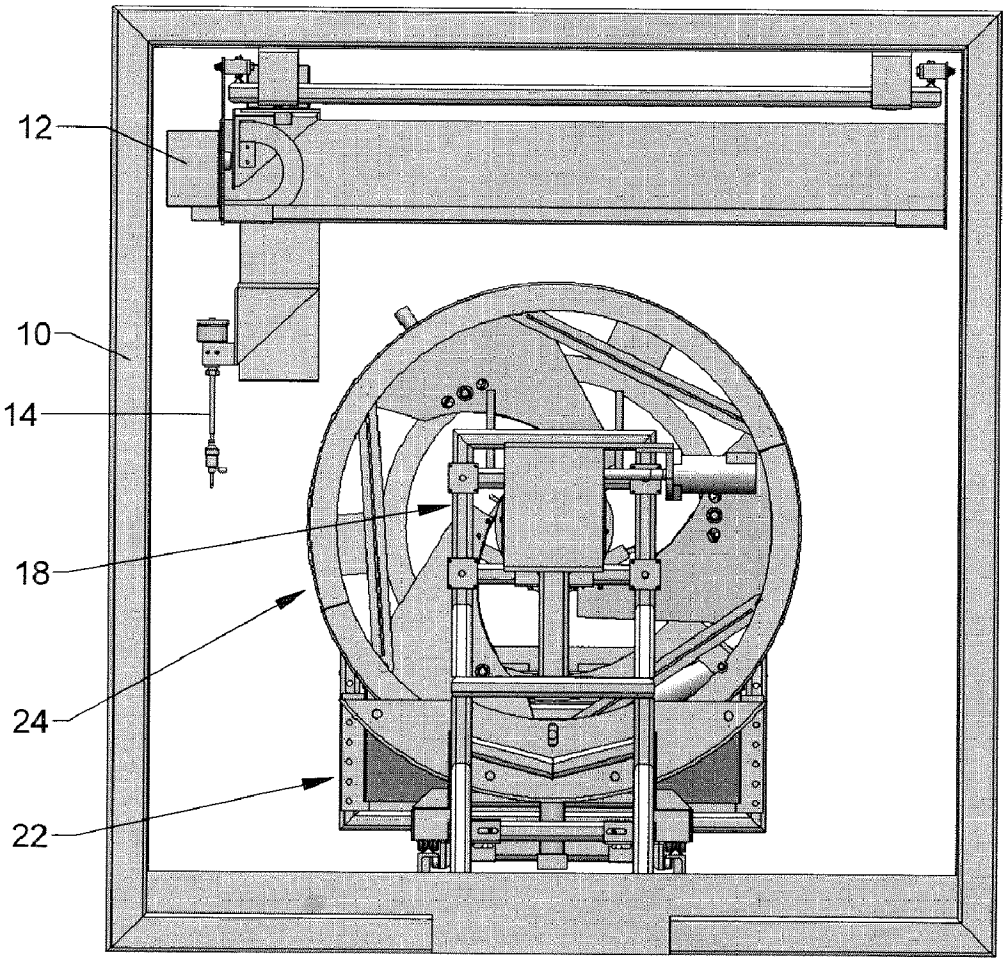
FIG. 16 hereof is a rear view, with it s back removed, of the portable demilitarization apparatus of the present invention.

Rotational drive subassembly 18 is illustrated in more detail in FIG. 14 hereof which shows a securing device 140 and rotational motor 142. Securing means 140, or device, is rotatable and has a surface configured for securely holding a cylindrical item. It is preferred that securing device 140 be a chuck of suitable size to securely hold and center the cylindrical item in slideable main assembly 2. Rotational motor 142 will be a size suitable for the item to be segmented. The motor will also capable of rotating the MPPEH item at a rotation of about 1 to about 10 rpm, preferably from about 1 to 5 rpm. Any suitable mechanism can be used to functionally link the rotational energy of rotational motor 142 to securing means 140. For example, the link can be a direct link to the rotational motor or it can be by use of a pulley/belt or chain system. Also suitable would be gearbox to directly transfer the rotation of the motor to securing means 140. Preferred is a direct link by use of gearbox 144. The height of securing device 140 can be adjusted for cases where the securing device is not directly linked to rotational motor 142.

The item to be segmented, or demilitarized, is preferably an ordnance or rocket motor containing propellants, explosives, or both. The item to be segmented is positioned in the slideable main assembly by sliding it backwards through centering ring 24 and into securing device 140, which secures the item in place at its base. MPPEH items, such as munitions (bombs and projectiles) will typically have a tapered nose end with the opposite end being the base end, which will often contain a fuse. Thus, the term "cylindrical" as used herein is not limited to a true cylinder having a substantially constant diameter along its entire length. The cylindrical items of the present invention can also have varying diameters along its length, such as bombs and projectiles that have a tapered nose end and an opposite flat end that often contains a fuse. It is preferred that such items be secured at the base end and be segmented starting from the nose end. It is, however, within the scope of this invention that such items can be secured at their nose end and can be segmented starting from their base end.

Once the MPPEH item 26 is properly secured and rotating on its longitudinal axis, the high pressure waterjet cutting head 14 is placed at the desired cutting location by manipulating the gantry/robotic positioning system 12. This placement of the cutting head can be accomplished remotely with the use of an operator station (not shown) and by use of a programmable logic controller (PLC)/human machine interface (HMI) system, which are well known in the art. The integration of this level of technology to position the high pressure waterjet cutting head further reduces the potential for human injury since it is done from a remote work station and is a significant advancement in the current technology. Segmenting (cutting) of item 26 is accomplished by remote initiation of the high pressure waterjet cutting head 14. The tool path and/or control of high pressure waterjet cutting head 14 to produce the operation desired can be done by a) manual control of the high pressure waterjet cutting head position, or by b) initiation of a preset tool-path program. Both a) and b) are accomplished by controlling the Gantry/Robotic Positioning System from a remote location.

In the current configuration, servo motors control 2 of the axis. One servo motor controls the left-right motion and the other controls the up/down motion of waterjet cutting head 14. The HMI is used to program the PLC to control the servo motors and hence the tool path. Before cutting, waterjet cutting head 14 is positioned such the waterjet issuing from the waterjet head impacts the ordnance to be segmented tangentially to the longitudinal axis of the ordnance. Next, the ordnance is rotated at a predetermined speed, preferably from about 0.5 to about 10 revolutions per minute (rpms), preferably from about 1 to 5 rpms, and more preferably from about 1 to 3 rpms. Finally, the program controlling the tool path is executed such that waterjet cutting head 14 slowly moves inward perpendicular to the longitudinal axis of the ordnance until the casing of the ordnance is completely cut through. This distance can be a fraction of an inch to well over an inch depending on the particular MPPEH item. Since items segmented in accordance with the present invention are typically cylindrical, as waterjet cutting head 14 is moved inward, it must be raised to keep the waterjet cutting head 14 from making contact with the item. Also, it is desired to keep the waterjet cutting head 14 as close as possible to the surface of the item being segmented i.e. minimize stand-off distance. Hence, the tool part is programmed to match the profile of the item being segmented. The last portion of cutting required is to slice through the energetic filler. To accomplish this, waterjet cutting head 14 is moved to the top of the item over the previously made cut so the energetic filler can be cut through in less than one revolution. This results in the item being segmented. As previously stated, the section or segment cut from the item is supported on platform 120 of collection subassembly 22.

Use of the present invention almost completely eliminates human interaction with the physical system (utilizing remote and automated technologies) and also ensures nearly 100% containment of the hazards involved via the method and containerization of the cutting are significant enhancements to the state of the art of processing of MPPEH materials in remote or unimproved areas of the world.

In accordance with the present invention the high pressure waterjet head is affixed to the gantry and/or robotic arm system that allows the head to be positioned remotely at any location within the processing envelope within the enclosure and to allow for programming of the head to follow complex cutting paths. This upgrade allows the head to be programmed by an operator that is remotely located. This significantly reduces the threat of personal injury by reducing the duration and frequency personnel are required to be at or around the items to be demilitarized. Additionally, the high pressure waterjet head being affixed to a remotely controlled device such as the gantry or robotic arm also allows the remote operator to respond to necessary repositioning of the cutting head during operation to avoid potential hazards that may develop during the accessing process.

Also, a rotation mechanism is used that allows for the item to be rotated on a predetermined axis. This allows for the accessing (cutting) to be performed by the waterjet head to produce cut segments of the item. The rotation mechanism of the present invention enhances prior designs in several ways. For example a clamping and centering ring is used to allow the item to be centered on a predetermined axis in the cutting envelope with minimal effort of personnel, again reducing possible injury to operators. The clamping and centering ring only requires minimal contact with the item in order to perform its function. This is extremely vital with items, such as ordnance that has experienced significant casing deformation and degradation from the effects of long term storage or weathering.

Further, the addition of complete containment and overpressure containerization results in substantial improvements in safety, operations, and environmental compliance. Decreased Quantity Distance is recommended for operations personnel due to the container and bracing integrity. This makes operations more efficient and increases the safety factor of surrounding ancillary equipment and personnel. Additionally, the processing of Ordnance and MPPEH inside of a fully contained processing envelope within an enclosure, in a remote field or unimproved area setting, allows for more control over possible releases and decreases the likelihood of environmental contamination. The combination of all of these improvements: programmable cutting head positioning; a universal centering and fixturing device; and high integrity complete containerization of the present invention forms a processing system that is a substantial improvement over conventional systems with regard to flexibility, safety, efficiency, operability, and environmental impact.

The present invention is especially applicable in instances where ordnance or other potentially explosive items are located in remote areas, or in areas that are deemed to be unfeasible to move the items from a safety and/or economic standpoint. As a result, it is necessary to bring equipment to the location of the items that are known to contain, or may contain energetic/hazardous materials, so that waterjet cutting technology can be used to render such items useless and safe.

What is claimed is:

1. An assembly for segmenting a potentially explosive cylindrical item comprising:

a) a fixed housing having:

i) four enclosing sides and one enclosed end;

ii) a waterjet cutting head having two or more degrees of movement;

iii) a rotational drive subassembly capable of securing one end of said cylindrical item and centering and rotating it;

b) a centering ring subassembly having a plurality of jaws that are radially adjustable for securing said cylindrical item and which is capable of rotating with said cylindrical item;

c) a slideable main assembly comprised of:

i) a cradle for supporting said cylindrical item, which cradle has a bar supporting member and a slideable air member and is capable of moving up and down;

ii) a collection subassembly for collecting cut sections of said cylindrical item and for collecting waste water from said waterjet cutting head.

2. The assembly of claim 1, further comprising a robotic positioning system being connected to the fixed housing and to the waterjet cutting head.

3. The assembly of claim 1 wherein the waterjet cutting head has at least three degrees of movement.

4. The assembly of claim 1 wherein the enclosed end is removable.

5. The assembly of claim 1 wherein the cylindrical item is secured by in the rotational drive subassembly be a securing device that has a surface configured to securely hold and center the cylindrical item.

6. The assembly of claim 1 wherein the rotation of said rotational drive subassembly is provided by a rotational motor linked to a securing device having a surface configured to securely hold and center the cylindrical item.

7. The assembly of claim 6 wherein the link is a direct link by use of a gearbox.

8. The assembly of claim 6 wherein the securing device is a chuck.

9. The assembly of claim 1 wherein the centering ring subassembly has three jaws which are substantially equidistant apart.

10. The assembly of claim 1 wherein the jaws are opened and closed by use of a hydraulic cylinder which is remotely controlled.

11. The assembly of claim 1 wherein the centering ring subassembly is supported by a supporting structure having wheels for allowing the centering ring subassembly to be moved from between a first position outside the housing and a second position inside the housing.

12. The assembly of claim 1 wherein the housing has a rail system connected thereto for allowing movement of slideable main assembly in and out of said housing, which rail system is extendable outside of said housing to a distance that will accommodate said slideable main assembly.

13. The assembly of claim 1 wherein the cradle for supporting said cylindrical item contains a sliding-aid member for helping move the cylindrical item into and out of said centering ring subassembly.

14. The assembly of claim 1 wherein said sliding-aid member is one or more ball bearings.

15. The assembly of claim 1 wherein the cradle bar member is V-shaped and securingly supports the cylindrical item.

16. The assembly of claim 1 wherein movement of the cradle up and down is provided by at least one hydraulic cylinder that is remotely controlled.

17. The assembly of claim 1 wherein the collection subassembly contains a tank for receiving water from the waterjet cutting head.

18. The assembly of claim 17 wherein the tank is adjustable up and down.

19. The assembly of claim 17 wherein the tank is covered with a porous sheet material capable of dissipating the energy of the waterjet.

20. The assembly of claim 19 wherein the porous sheet material is comprised of a polymeric material.

21. The assembly of claim 19 wherein the porosity of the sheet material is provided by a honey cone design.

22. The assembly of claim 21 wherein the sheet material is supported by a metallic grid.

23. The assembly of claim 17 wherein an emptying system is provided in said tank to continuously or intermittently empty the tank during operation of the waterjet cutting head.

24. The assembly of claim 1 wherein each jaw contains a lip having at least one positioning pad secured thereto for contacting the outer surface of the cylindrical item.

25. The assembly of claim 1 wherein the collection subassembly contains a moveable platform for collecting sections cut from the cylindrical item.

26. The assembly of claim 25 wherein the platform is moveable up and down by use of a hydraulic cylinder that is remotely operated.

* * * * *